United States Patent [19]

Dahlgren et al.

[11] Patent Number: 4,976,313

[45] Date of Patent: Dec. 11, 1990

[54] PLATE HEAT EXCHANGER WITH A DOUBLE-WALL STRUCTURE

[75] Inventors: Arthur Dahlgren; Magnus Källrot, both of Lund; Mats Strömblad, Bjärred, all of Sweden

[73] Assignee: Alfa-Laval Thermal AB, Sweden

[21] Appl. No.: 340,419

[22] PCT Filed: Oct. 19, 1987

[86] PCT No.: PCT/SE87/00478

§ 371 Date: Mar. 22, 1989

§ 102(e) Date: Mar. 22, 1989

[87] PCT Pub. No.: WO88/03253

PCT Pub. Date: May 5, 1988

[51] Int. Cl.[5] ..... F28F 3/04

[52] U.S. Cl. ..... 165/167; 165/70; 165/166

[58] Field of Search ..... 165/70, 166, 167

[56] References Cited

U.S. PATENT DOCUMENTS 4,249,597 2/1981 Carey ..... 165/166

4,402,359 9/1983 Carnavos et al. ..... 165/70

FOREIGN PATENT DOCUMENTS 2454075 11/1980 France .

*Primary Examiner*—Martin P. Schwadron

*Assistant Examiner*—Allen J. Flanigan

*Attorney, Agent, or Firm*—DAvis Hoxie Faithfull & Hapgood

[57] ABSTRACT

In a series of heat exchange plates (5, 6), each being rectangular with ports (7, 8, 9, 10) in its corner portions, alternate plates (6) are fully sealed and coact with intermediate plates (5) to define two groups of elongated passages through which the respective heat exchanging fluids (A, B) flow. Each intermediate plate (5) is only partially sealed and defines with one of the two adjacent fully-sealed plates (6) an area communicating directly with the atmosphere, the partial sealing consisting of port sealing means (7a, 8a, 9a, 10a) interconnecting respective pairs of opposing ports to form channels through which the two fluids (A, B) flow without entering said area. The areas form paths through which any leakage of either fluid (A, B) can escape to the atmosphere, thus preventing contamination of either fluid by the other.

6 Claims, 2 Drawing Sheets

PLATE HEAT EXCHANGER WITH A DOUBLE-WALL STRUCTURE

The present invention relates to plate heat exchangers of the type having a series of heat exchange plates sealed from each other and forming interplate passages for flow of two fluids which exchange heat through the plates. More particularly, the invention relates to a novel arrangement of the plates and the sealing means which allows any leakage of either fluid to escape to atmosphere without contaminating the other fluid.

BACKGROUND OF THE INVENTION

In a heat exchanger, such as for heating and cooling of potable water or cooling of electrical transformers, a double-wall structure is desired between adjoining passages through which separate fluids are circulated, to prevent cross-contamination between a primary flow and a secondary flow of the heat exchanger.

In connection with plate type heat exchangers a double-wall structure has already been proposed in FR-A1 2454075 which discloses a plate heat exchanger wherein two identically corrugated plates are put together. A gap is formed between the two plates of the double-wall, which gap communicates with the atmosphere and through which a leakage of a fluid can escape to the atmosphere. Further, an interjacent wire netting can be used to increase the heat transfer between the plates. US 4 249 597 also discloses a plate heat exchanger having a double-wall structure. The heat exchanger comprises a plurality of identical plates assembled in pairs. Each plate has a series of protuberant channel portions looping back and forth between the short sides and along the long sides of the plate in an even number of parallel rows. Between said parallel rows there is a planar portion. The planar portions of each pair face each other and sealingly abut to provide a brazeable connection and seal therebetween. Two pairs of plates are then arrangeable to closely nest with each other by turning the two pairs 180° with respect to each other. The channel portions at opposed sides of said pairs of plates nest alongside each other providing surface-to-surface contact between the channel portions. However, the planar portions at opposed sides of said pairs of plates are spaced from each other providing channels therebetween, through which any leakage can escape to the atmosphere.

The two above mentioned references only partly show a surface-to-surface contact between the plates of the double-wall structure and therefore the heat transfer between the plates has not proved to be efficient enough.

OBJECT OF THE INVENTION

The principal object of the present invention is to provide a heat exchanger of the sealed plate type which allows a leakage of either of the two heat exchanging fluids to escape to atmosphere so as to avoid contamination of the other fluid and which has a higher efficiency compared with previously known heat exchangers of the double-wall structure type.

BRIEF SUMMARY OF THE INVENTION

A plate heat exchanger according to the invention comprises a series of heat exchange plates arranged in a pack, including alternate plates and other plates intermediate the alternate plates, each plate being generally rectangular with a pressed corrugation pattern of ridges and valleys and having through flow ports in corner portions thereof, for two heat exchanging fluids, first sealing means between each alternate plate and one of the two adjacent intermediate plates, said first sealing means defining an elongated passage for flow of one of the heat exchanging fluids from a said port at one end to a said port at the opposite end of said passage, alternate ones of said passages accommodating flow of a first said fluid and the other passages accommodating flow of a second said fluid, said first sealing means also defining a channel interconnecting opposing ports to accommodate flow of the other of said heat exchanging fluids bypassing said passage, each alternate plate and the other of said two adjacent intermediate plates forming a double-wall unit so arranged that an area between the two plates forms a path through which leakage of a said fluid can escape to the atmosphere. The plate heat exchanger according to the invention is characterized in that said plates constituting each doublewall unit are so formed that they are pressed into each other by plastic metal deformation of the plates such that the ridges of the corrugation pattern of one plate will lie closely against the corresponding valleys of the corrugation pattern of the other plate and vice versa, the plates being formed thereby to establish a surface-to-surface contact between the plates all over the portions thereof forming said passages and around each pair of opposing ports, and further characterized in that a second sealing means in the form of a welded or soldered joint interconnects and surrounds each pair of opposing ports in the plates of said double-wall-unit to define channels through which both of said fluids can pass separately without entering said area.

The invention thus suggests an arrangement that provides a complete surface-to-surface contact between the heat transferring portions of each double wall unit and, furthermore, provides a close contact between said plates around their opposing ports such that soldering or welding can be easily performed for the obtainment of said second sealing means.

BRIEF DESCRIPTION OF THE DRAWINGS

For a better understanding of the invention, reference is made to the accompanying drawings in which.

DETAILED DESCRIPTION

Figure 1:
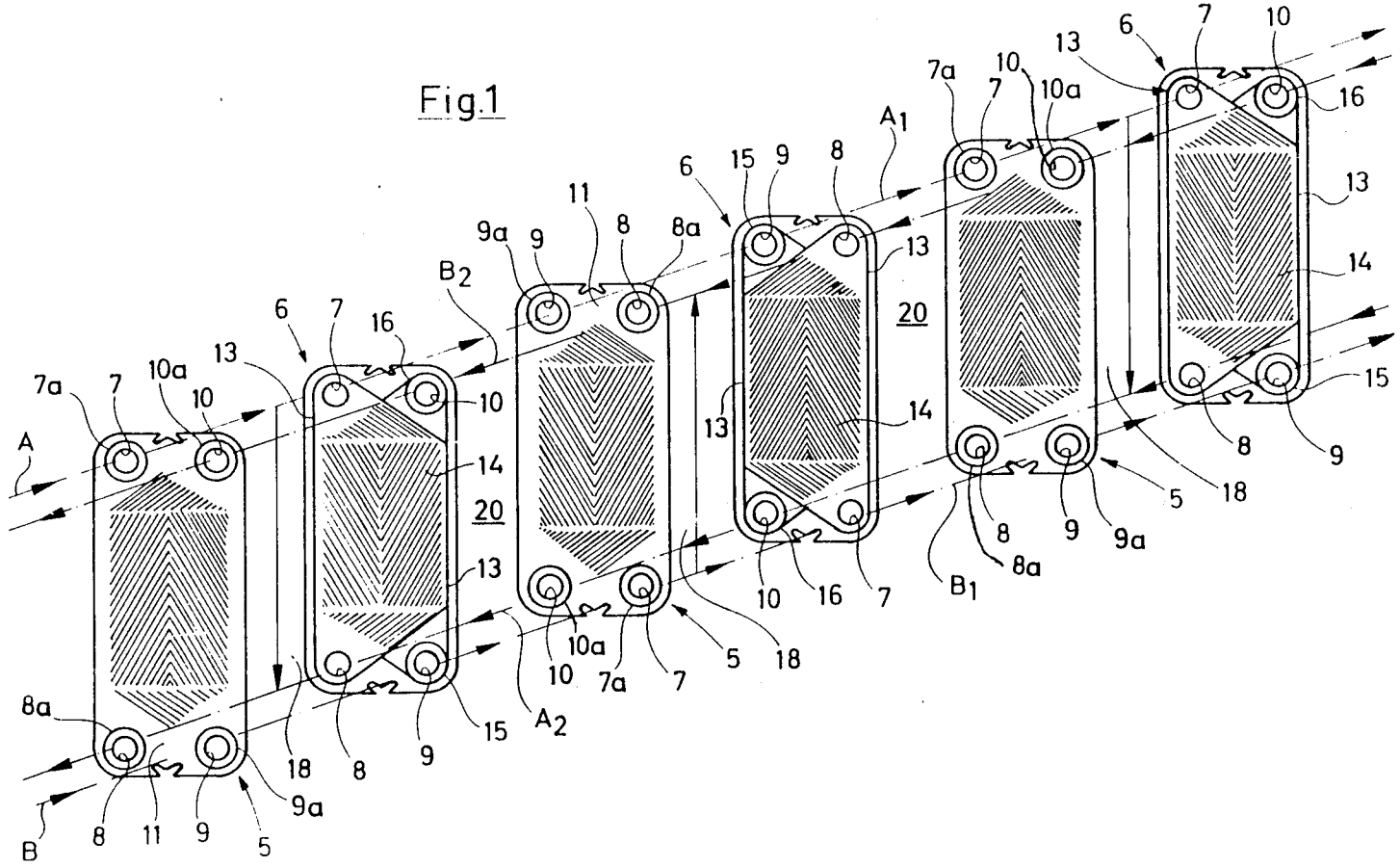
FIG. 1 is an exploded schematic view of a series of heat exchange plates and their sealing means, according to the invention.

The series of heat exchange plates shown in FIG. 1 consists of alternate plates 6 and other plates 5 intermediate the alternate plates. Each plate is generally rectangular and has through flow ports 7, 8, 9 and 10 in its four corner portions for two heat exchanging fluids. Each plate also has a front face 11 and a rear face (not shown).

On the front face 11 of each alternate plate 6 there is a first sealing means comprising a boundary gasket 13, enclosing an area which includes two of the ports 7, 8 and a heat transfer surface formed by a herringbone pattern of corrugations 14, and two port gaskets 15 and 16, surrounding the other two ports 9 and 10, respectively. The first sealing means is preferably made of rubber or plastics material.

On the front face of each intermediate plate 5 there is second sealing means comprising four weld joints *7a*, 8a, 9a and 10a surrounding ports 7, 8, 9 and 10, respectively, and connecting the front face of the intermediate plate 5 and the opposing rear face of the alternate plate 6 with each other at the four ports. Instead of a weld joint the sealing means can be a soldered joint. The gaskets 13 and 15–16 are held in narrow grooves pressed in the respective plates, grooves for boundary gaskets 13 being shown at 13a in FIG. 2. Also, the illustrated plates constitute only part of a complete series forming a pack of plates mounted on horizontal carrying bars and compressed between vertical frame members (not shown), one or both of these members having fittings through which the two heat exchanging fluids are passed separately to and from the plate pack. This arrangement, being conventional, is not described further.

Each alternate plate 6 is turned 180° in its own plane relative to the next alternate plate 6. Thus, of the three alternate plates 6 in FIG. 1, the middle one has its corrugations 14 slanting downwards from the centerline of the herringbone, while the other two have their corrugations 14 slanting upwards. Similarly, each intermediate plate 5 is turned 180° in its own plane relative to the next intermediate plate 5.

With the gasketed plates pressed together in a pack, the first sealing means 13, 15–16 on the front face of each alternate plate 6 engages the rear face of an adjacent intermediate plate 5, thereby defining an elongated passage 18 for flow of a heat exchanging fluid from a port 7 at one end of the passage to a port 8 at the opposite end of the passage (FIG. 1). The gasketing is such that alternate ones of these flow passages 18 accommodate flow of a first heat exchanging fluid while the other passages accommodate flow of a second heat exchanging fluid. Thus, in FIGS. 1 and 2 one of the fluids flows through the middle passage while the other fluid flows through the other two passages.

Port gaskets 15 and 16 of each first sealing means engage the opposing rear face of an adjacent intermediate plate 5 outside the corresponding passage 18, so as to interconnect opposing ports 9–9 and 10–10. Gaskets 15 and 16 thus form respective channels for flow of one of the two fluids bypassing the corresponding passage 18.

The front face of each intermediate plate 5 and the opposing rear face of the next alternate plate 6 form an intervening area 20 which communicates directly with the atmosphere, since there is no boundary gasket between these two plates. Each area 20 contains port sealing means 7a–10a in the form of weld joints surrounding the ports 7–10. Thus, these weld joints connect the four ports of each intermediate plate 5 with the opposing four ports of the alternate plate 6 immediately in front of the plate 5, thereby forming respective bypass channels. These four channels provide paths for flow of the two heat exchanging fluids without entering the corresponding area 20.

In operation, the two heat exchanging fluids are introduced to the plates from the left in FIG. 1, as shown at A and B, the paths of the two fluids being shown in broken lines. Fluid A flows in a path A1 through ports in the upper left-hand corners of the plates while branches of this fluid flow downward through the first and third passages 18 to join the returning fluid in a path A2 through ports in the lower left-hand corners of the plates. The other fluid B flows in a path B1 through ports in the lower right-hand corners of the plates while a branch of this fluid flows upward through the second passage 18 to join the returning fluid in a path B2 through ports in the upper right-hand corners of the plates.

The return paths A2 and B2 exit through fittings in a header (not shown) which also has fittings for supplying the two fluids. However, in some instances the heat exchanger may have headers at opposite ends, each with two fittings for the respective fluids, so that the fluids do not return to the same header which supplied them. Also, although the plates as shown are gasketed for parallel flow of each fluid, they may be arranged for series flow.

As shown in FIG. 1, each flow passage 18 is formed by plates 5 and 6 which are 180° out of phase with each other, so that the corrugations 14 of one plate cross and abut the corrugations of the other plate. Thus, the two plates contact each other. On the other hand, each area 20 is formed by plates 5 and 6 which are in phase with each other, so that the ridges of the corrugations 14 of the front face of the plate 5 will fall down into corresponding valleys of the corrugations 14 of the opposing rear face of the adjacent plate 6 (see FIG. 2).

The greatest problem with heat exchangers of the double-wall type is the low heat transfer between the two flow passages through the double-wall. In previously known plate heat exchangers having double-wall the heat transfer essentially depends on an air gap of low heat conductance between the two plates constituting the double-wall. This problem has been solved by the present invention, providing a plate heat exchanger of higher efficiency compared with previously known plate heat exchangers having double-wall structure.

Figure 2:
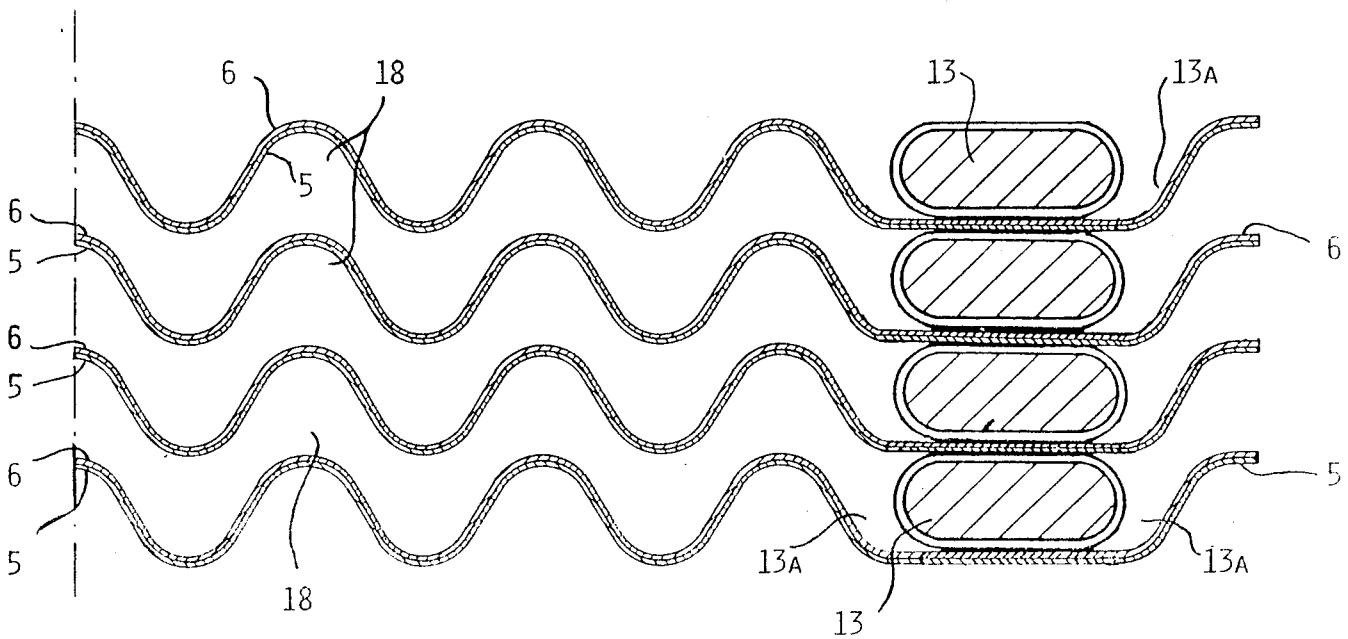
FIG. 2 is a cross-sectional view in part of an assembly of eight sealed plates according to FIG. 1.

As is illustrated in FIG. 2, an alternate plate 6 and an intermediate plate 5 form a double-wall unit, separating two different flow passages 18 from each other. In this connection the two plates are formed in such a way that they come as close as possible against each other.

Thus, the two plates are pressed into each other by plastic metal deformation of the plates such that the ridges of the corrugations of the front face of one plate will fall into the corresponding valleys of the corrugations of the opposing rear face of the adjacent plate and vice versa, thereby a surface-to-surface contact is established between the plates. Such contact is also established around each pair of opposing ports. Therefore it is possible that a second sealing means in the form of a welded or soldered joint can interconnect and surround each pair of opposing ports in the plates of the said double-wall unit to define channels through which both of said fluids can pass separately without entering said area.

According to a first method two metal sheets are inserted into a press tool, whereafter the press tool is forming the corrugation pattern in the two plates simultaneously. By so doing the air between the two plates is pressed away so that there will be a very good metallic contact between the two plates constituting the double-wall.

After this pressing moment the two plates are welded together at the ports of the plates by means of a weld joint which surrounds each port and connects the four ports of one plate with the opposing four ports of the other plate having the consequence that bypass channels are formed which provide paths for flow of the two heat exchange fluids without entering the area between the two plates.

Instead of welding together the two plates forming the plate couple, the fastening operation can be done by soldering.

According to a second method a metal sheet is first pressed so that a plate with corrugation pattern is formed. After that moment another metal sheet is placed against the first plate, either on top of the first plate or beneath the same, whereafter the second metal sheet is pressed into the first plate. Thereby a corresponding corrugation pattern is formed in the second plate as in the first plate. Moreover, the ridges of the corrugations of the front face of one of the plates will lie closely against the corresponding valleys of the corrugations of the other plate such that a very tight double-wall unit is created.

After this pressing moment the two plates are welded together at the ports in the same way as according to the first method.

As mentioned previously the two plates forming the double-wall unit are sealed from each other by a welded or soldered joint surrounding each pair of opposing ports. By so doing the two plates are tightly fastened to each other and form an entirely leakage-free and compact double-wall structure.

As seen in FIG. 2 the plate heat exchanger is built up by a number of double-wall units, each of which separating two different flow passages 18 from each other. Two adjacent double-wall units are separated from each other by a sealing means consisting of a rubber gasket but instead of being made of rubber the sealing means can be made of plastics material or of metal, whereby the latter may be formed as a welded or soldered joint.

We claim:

1. A plate heat exchanger comprising a series of heat exchange plates arranged in a pack, including alternate plates and other plates intermediate the alternate plates, each plate being generally rectangular with a pressed corrugation pattern of ridges and valleys and having through flow ports in corner portions thereof for two heat exchanging fluids, and first sealing means between each alternate plate and one of the two adjacent intermediate plates defining an elongated passage for flow of one of the heat exchanging fluids from a said port at one end to a said port at the opposite end of said passage, alternate ones of said passage accommodating flow of a first said fluid and the other passages accommodating flow of a second said fluid, said first sealing means also defining a channel interconnecting opposing ports to accommodate flow of the other of said heat exchanging fluids bypassing said passage, each alternate plate an the other of said two adjacent intermediate plates forming a double-wall unit so arranged that an area between the two plates may form a path through which leakage of a said fluid through one of the plates can escape between the plates to the atmosphere, characterized in that each plate of each double wall unit is shaped to the other plate of the unit so that the ridges and valleys of each plate of said unit will conform to and intimately contact the ridges and valleys of the other across the entire area of said passages and the portions around the ports, and that second sealing means in the form of welded or soldered joints interconnect the plates of said double-wall unit at their said contacting portions surrounding each pair of opposing ports to form channels through which both of said fluids can pass separately without entering said area between the plates.

2. Plate heat exchanger according to claim 6, characterized in that said second sealing means constitutes the only sealing means in said area.

3. Plate heat exchanger according to claim 6, characterized in that the corrugations of each plate form a herringbone pattern.

4. Plate heat exchanger according to claim 1, characterized in that alternate ones of said alternate plates are turned 180° in their own planes relative to the others of said alternate plates, alternate ones of said interplates being turned 180° relative to the others of said intermediate plates.

5. Plate heat exchanger according to claim 1, characterized in that the plate heat exchanger is built up by a number of double-wall units which are separable from each other.

6. Plate heat exchanger comprising a series of heat exchange plates arranged in a pack, including alternate plates and other plates intermediate the alternate plates, each plate being generally rectangular with a pressed corrugation pattern or ridges and valleys and having through flow ports in corner portions thereof for two heat exchanging fluids, and first sealing means between each alternate plate and one of the two adjacent intermediate plates defining an elongated passage for flow of one of the heat exchanging fluids from a said port at one end to a said port at the opposite end of said passage, alternate ones of said passages accommodating flow of a first said fluid and the other passages accommodating flow of a second said fluid, said first sealing means also defining a channel interconnecting opposing ports to accommodate flow of the other of said heat exchanging fluids bypassing said passage, each alternate plate and the other of said two adjacent intermediate plates forming a double-wall unit so arranged that an area between the two plates may form a path through which leakage of a said fluid through one of the plates can escape between the plates to the atmosphere, characterized in that each double wall unit has been formed by plastic metal deformation of at least one of the plates of said unit, while juxtaposed against the other plate, into the desired corrugation pattern so that the ridges and valleys of each plate of said unit will conform to and intimately contact the ridges and valleys of the other across the entire area of said passages and the portions around the ports, and that second sealing means in the form of welded or soldered joints interconnect the plates of said double-wall unit at their said contacting portions surrounding each pair of opposing ports to form channels through which both of said fluids can pass separately without entering said area between the plates.

* * * * *

UNITED STATES PATENT AND TRADEMARK OFFICE

CERTIFICATE OF CORRECTION

PATENT NO. : 4,976,313

DATED : December 11, 1990

INVENTOR(S) : Arthur Dahlgren and Magnus Kallrot

It is certified that error appears in the above-identified patent and that said Letters Patent is hereby corrected as shown below:

Column 1, line 29, "US" should begin new paragraph.

Column 2, line 20, "doublewall" should be --double-wall--.

Column 3, line 5, "The" should begin a new paragraph.

Column 6, line 7 (Claim 2), "6" should be --1--.

Column 6, line 10 (Claim 2), "6" should be --1--.

Column 6, line 27 (Claim 6), "or" should be --of--.

Signed and Sealed this

Twenty-fourth Day of November, 1992

*Attest:*

DOUGLAS B. COMER

*Attesting Officer*

*Acting Commissioner of Patents and Trademarks*